US008066038B2

(12) United States Patent
Jones

(10) Patent No.: US 8,066,038 B2
(45) Date of Patent: Nov. 29, 2011

(54) DEVICE FOR SECURING A DISPENSING NOZZLE TO A FILL TANK

(76) Inventor: Ronda Kay Jones, Cape Girardeau, MO (US)

( * ) Notice: Subject to any disclaimer, the term of this patent is extended or adjusted under 35 U.S.C. 154(b) by 983 days.

(21) Appl. No.: 11/804,571

(22) Filed: May 18, 2007

(65) Prior Publication Data

US 2008/0098708 A1 May 1, 2008

Related U.S. Application Data

(60) Provisional application No. 60/802,019, filed on May 19, 2006.

(51) Int. Cl.
*B65B 1/04* (2006.01)

(52) U.S. Cl. ..... 141/383; 141/346

(58) Field of Classification Search ..... 141/311 R, 141/346, 382, 383
See application file for complete search history.

(56) References Cited

U.S. PATENT DOCUMENTS

| | | | | |
|---|---|---|---|---|
| 3,291,165 | A * | 12/1966 | Fraylick | 141/286 |
| 3,431,947 | A * | 3/1969 | Hines | 138/106 |
| 3,759,423 | A * | 9/1973 | Hansel | 222/153.01 |
| 4,557,302 | A | 12/1985 | Sunderhaus | |
| 5,031,790 | A * | 7/1991 | Keller | 220/203.2 |
| 5,070,806 | A * | 12/1991 | Coster | 114/343 |
| 5,385,182 | A | 1/1995 | Dyer | |
| 5,515,893 | A * | 5/1996 | Donohue | 141/392 |
| 6,923,226 | B2 * | 8/2005 | Bartlett | 141/390 |
| 7,017,630 | B2 | 3/2006 | Dikken | |
| 2007/0108211 | A1 * | 5/2007 | Zhu | 220/367.1 |

* cited by examiner

*Primary Examiner* — Timothy L Maust
*Assistant Examiner* — Jason K Niesz
(74) *Attorney, Agent, or Firm* — Shook Hardy & Bacon LLP

(57) ABSTRACT

A device for securing a dispensing nozzle to a fill tank includes a securing mechanism and a means for connecting the securing mechanism to the fill tank's cap chain. After connected to a fuel tank cap chain and upon subsequent attachment to a dispensing nozzle, the device prevents the nozzle from dislodging from the fuel tank.

15 Claims, 2 Drawing Sheets

DEVICE FOR SECURING A DISPENSING NOZZLE TO A FILL TANK

CROSS-REFERENCE TO RELATED APPLICATIONS

This nonprovisional patent application claims the benefit of provisional application No. 60/802,019 filed on May 19, 2006.

STATEMENT REGARDING FEDERALLY SPONSORED RESEARCH OR DEVELOPMENT

Not Applicable

INCORPORATION-BY-REFERENCE OF MATERIAL SUBMITTED ON A CD

Not Applicable

BACKGROUND OF THE INVENTION

The present invention relates to a device for securing a dispensing nozzle to a fill tank. While this application focuses on the invention's usefulness for securing a gasoline, diesel, or other fuel dispensing nozzle to a fill tank on a passenger or other motorized vehicle (truck in the trucking industry), one of ordinary skill in the art would recognize the invention's applicability for securing any type of dispenser to a receiving container.

During refueling of fuel tanks on motor vehicles, such as semi-trucks, a driver will often leave the nozzle unattended without any means to secure the nozzle to the fill tank. As a result, fuel spills occur where the nozzle dislodges from the tank due to a variety of factors, including, but not limited to, manual interference with the nozzle's hose, weather conditions, and pressure changes in the fuel line. Such spillage creates environmental clean-up issues, pollution, health and safety risks, and other undesirable hazards.

Some devices endeavor to rectify this problem.

For example, U.S. Pat. No. 7,017,630 introduces a spout coupling and member extending therefrom into the fuel tank.

In addition, U.S. Pat. No. 5,385,182 introduces a nozzle clamp and latch, which also extends into the fuel tank.

In addition, U.S. Pat. No. 4,557,302 introduces a nozzle retainer ring.

Such devices function by long term modification of or attachment to a dispensing nozzle and are not designed to be easily transported with a tank from one nozzle to the next in between fueling. Presently, no device exists that a driver can transport between and use at various fueling stations. Furthermore, prior devices, such as those cited previously may be obsolete where fuel tank inlets are too narrow to permit the insertion of the devices.

A device for securing a dispensing nozzle to a fill tank that does not rely on or operate by long-term attachment to a dispensing nozzle or by insertion into a fuel tank inlet would constitute a significant advancement in the art.

BRIEF SUMMARY OF THE INVENTION

There is now provided a device for securing a dispensing nozzle to a fill tank possessing a tank cap and cap chain, the device comprising a securing mechanism connected to the cap chain. Generally, the securing mechanism is adapted for both secure attachment to the cap chain and simultaneous releasable attachment to the dispensing nozzle, thereby preventing the nozzle from disengaging from the fill tank while filling the tank with the nozzle.

One embodiment of the present invention provides a device for securing a dispensing nozzle to a fill tank possessing a tank cap and cap chain, the device comprising a securing mechanism connected to said cap chain and a means for connecting the securing mechanism to the cap chain.

A further embodiment provides a device for securing a dispensing nozzle to a fill tank possessing a fill spout. The device comprises a fill tank cap providing means for preventing the contents of said fill tank from spilling out of the fill tank's fill spout; a cap chain having an end A and an end B, connected at end A to said fill tank and connected at end B to said fill tank cap; and a securing mechanism connected to said cap chain, the securing mechanism being adapted for attachment to the dispensing nozzle, said securing mechanism, when attached to the dispensing nozzle, preventing the nozzle from disengaging from the fill tank.

Several advantages are realized from the various embodiments of the present invention. For example, the present invention provides for an inexpensive and easy way to prevent fuel spillage resulting from nozzle disengagement. Such prevention will protect persons and the environment and help to avoid the expenditure of time, resources, and money required for cleaning up fuel spills. In addition, the present invention can be transported with a fuel tank so that the driver or other nozzle operator has access to a means of securing the nozzle to the fuel tank at every fueling station. In addition, embodiments described herein allow for a securing end of the device to be hooked onto the fuel cap chain when not in use, thereby providing for easy storage of the invention inside a fuel tank spout. Moreover, the embodiments of the present invention disclose a configuration comprising a handle that allows for easy manipulation of the device when securing the device onto a nozzle. Additionally, the present invention permits use of the device with a variety of tank and nozzle styles and configurations. Furthermore, because the present invention does not rely on insertion into a tank's fuel inlet, the present invention does not hinder a nozzle's insertion into the inlet. Additional advantage of the present invention may be realized by the further embodiments described hereafter.

DETAILED DESCRIPTION OF THE INVENTION

Figure 1:
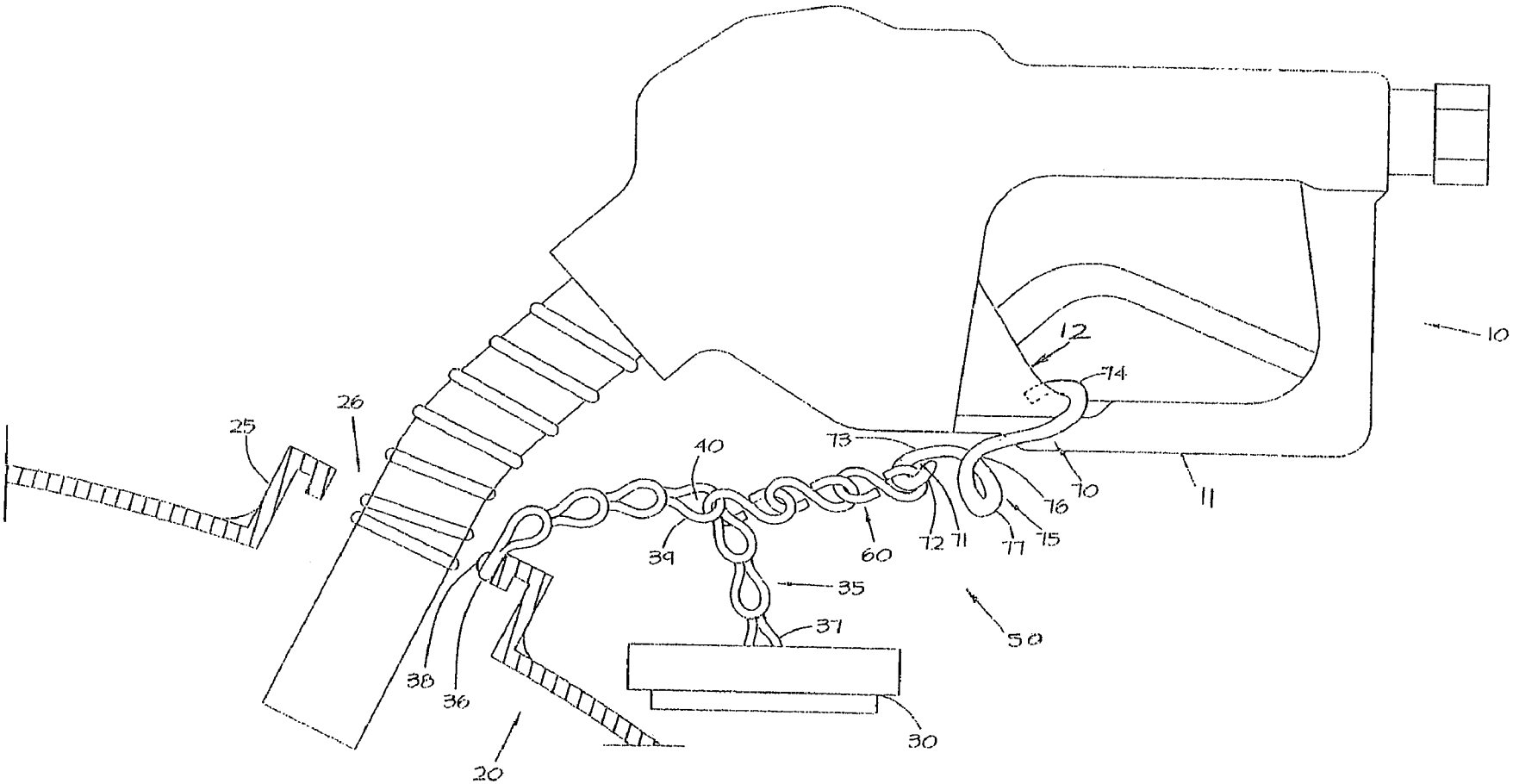
FIG. 1 is a side view of a device for securing a dispensing nozzle to a fill tank, where the device is installed on the fill tank and attached to nozzle, thereby securing the nozzle in place.

Reference is first made to FIG. 1 to describe one embodiment of the present invention (generally indicated by the numeral 50) which comprises a device 50 for securing a dispensing nozzle 10 to a fill tank 20 possessing a tank cap 30 and cap chain 35.

In one embodiment, the device 50 comprises a securing mechanism 70 connected to the cap chain 35, the securing mechanism 70 being adapted for attachment to the dispensing nozzle 10, said securing mechanism 70, when attached to the dispensing nozzle 10, preventing the nozzle 10 from disengaging from the fill tank 20.

In one embodiment, the device 50 comprises a means 60 for connecting the device 50 to the cap chain 35 and a securing mechanism 70 attached to the means 60 for connecting. Those skilled in the art appreciate that the device 50 is effective where fixed to any part of the fill tank 20. The securing mechanism 70 is adapted for attachment to the dispensing nozzle 10, and when the securing mechanism 70 is attached to the dispensing nozzle 10, the securing mechanism 70 prevents the nozzle 10 from disengaging from the fill tank 20.

In one embodiment of the invention 50, the means 60 for connecting the device 50 to the cap chain 35 is optionally one of a variety of components including, but not limited to, ties, clasps, clamps, latches, toggles, hooks, clips, pins, prongs, anchors, nut and bolt combinations, snaps, cable, rope, chains with at least one link, and a combination thereof. These means for connecting function generally by utilizing a link on the cap chain 35 and a void 71 defined by a portion 72 of the securing mechanism 70. One could employ a latch, toggle, hook, prong, pin, anchor, and nut and bolt combination in the following manner: while the means are placed simultaneously within a cap chain link's center and a void defined by a portion of the securing mechanism, the end portions of the means may be capped or shaped to prevent disconnection. In the alternative, one could employ ties, clasps, clamps, clips, snaps, cable, rope, and chains with at least one link in the following manner: while the means for connection is placed simultaneously within a cap chain link's center and a void defined by a portion of the securing mechanism, an end portion of the means can be united with another portion of the means, such as by bending or tying the means, in a fashion so as to prevent the means for connection from becoming unconnected.

Figure 2:
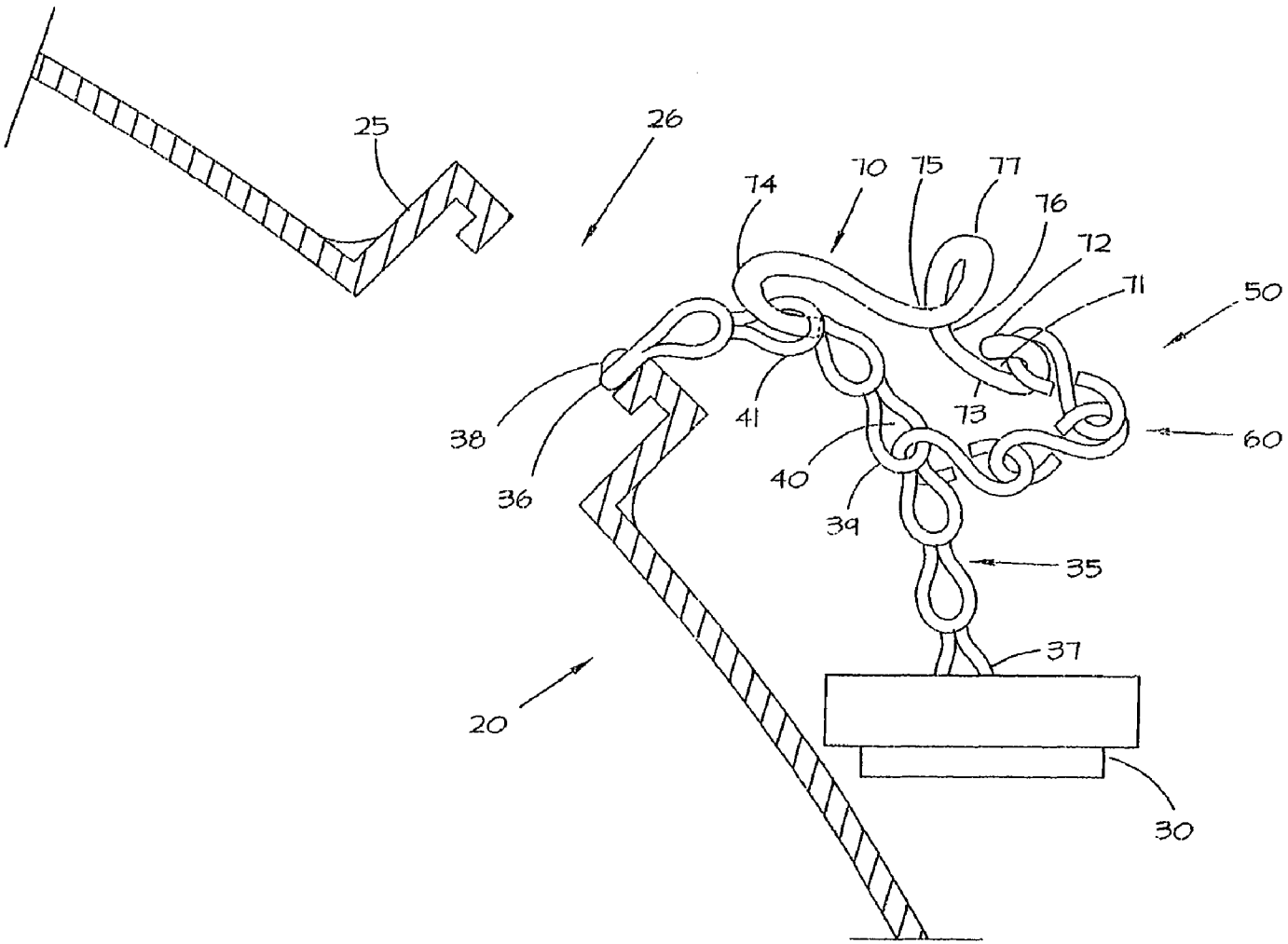
FIG. 2 is a side view of the device installed on a fill tank and in a non-use position, prepared to be placed in a stored state.

In one embodiment of the present invention 50, the means for connecting 60 comprises a flexible member having a proximal end and a distal end. The proximal end of the flexible member is connected to the cap chain 35 by interlocking with a link on the cap chain. The distal end of the flexible member is connected to the securing mechanism 70 by interlocking with a void 71 defined by a portion 72 of the securing mechanism 70. The flexible member can be, but is not limited to, a chain with at least one link, a cable, and a rope. FIGS. 1 and 2 specifically show an embodiment of the present invention where the flexible member is a chain with at least one link. The link at the proximal end of the chain 60 connects to the cap chain 35 by interlocking with a cap chain link 39. The link at the distal end of the chain 60 connects to the securing mechanism 70 by interlocking with a void 71 defined by a portion 72 of the securing mechanism 70.

In another embodiment of the present invention 50, the securing mechanism 70 comprises a first end 73 having portions 72 defining a void 71, wherein the means 60 for connection can engage with the void 71 thereby connecting the securing mechanism 70 to means 60, and a hook-shaped second end 74, said second end for attachment to the dispensing nozzle 10. The means 60 for connection may engage with the void 71 in a variety of ways as previously explained. FIGS. 1 and 2 illustrate the means 60 for connection as a chain, whereby the link at the distal end of the chain engages with the void 71, thereby connecting the securing mechanism 70 to the means 60 for connecting.

In another embodiment, the securing mechanism 70 is a hook.

In another embodiment, the hook has a handle 75 extending from the body thereof, said handle 75 providing a means to easily maneuver and operate the device 50.

In another embodiment, the securing mechanism 70 is comprised of a first end 73 having portions 72 defining a void 71, wherein the means 60 for connecting can engage with the void 71 thereby connecting the securing mechanism 70 to the means 60 for connecting; a handle 75 comprising a base 76 and a projecting member 77, said base 76 attached to and extending from the first end 73 and said projecting member 77 extending from said base 76 and providing a means to maneuver and operate the device 50; and a hook-shaped second end 74 attached to and extending from said base 76, said second end 74 for attachment to the dispensing nozzle 10. The handle 75 provides easy manipulation of the device. The hook-shaped second end 74 could optionally be one of a variety of components including, but not limited to, a hook or a latch. The hook-shaped second end 74 operates to secure the nozzle 10 in place so that it does not disengage while transferring contents into the fill tank 20. The hook-shaped second end 74 can secure the nozzle 10 by hooking onto the nozzle. In one embodiment of the present invention the hook-shaped second end 74 can secure the nozzle 10 by hooking onto a lip 12 created by a bottom portion 11 of the nozzle.

In another embodiment, the present invention discloses a device 50 for securing a dispensing nozzle 10 to a fill tank 20 possessing a fill spout 25, the device comprising a fill tank cap 30 providing means for preventing the contents of said fill tank from spilling out of the fill tank's fill spout; a cap chain 35 having an end A 36 and an end B 37, connected at end A 36 to said fill tank 20 and connected at end B 37 to said fill tank cap 30; and a securing mechanism 70 connected to said cap chain 35, the securing mechanism 70 being adapted for attachment to the dispensing nozzle 10, said securing mechanism 70, when attached to the dispensing nozzle 10, preventing the nozzle 10 from disengaging from the fill tank 20. FIG. 1 illustrates end A 36 as being connected to a fill tank 20 at the tank opening, using a pin 38; however, end A 36 could be connected to a fill tank at any depth within the fill tank by a pin or other fastening means that passes through a link or other void at end A.

In another embodiment, the present invention discloses a device for securing a dispensing nozzle 10 to a fill tank 20 possessing a fill spout 25, the device comprising a fill tank cap 30 providing means for preventing the contents of said fill tank from spilling out of the fill tank's fill spout; a cap chain 35 having an end A 36 and an end B 37, connected at end A 36 to said fill tank 20 and connected at end B 37 to said fill tank cap 30; a securing mechanism 70 connected to said cap chain 30, the securing mechanism 70 being adapted for attachment to the dispensing nozzle 10, said securing mechanism 70, when attached to the dispensing nozzle 10, preventing the nozzle 10 from disengaging from the fill tank 20; and a means 60 for connecting the securing mechanism 70 to the cap chain 35.

As shown in FIG. 2, the present invention discloses characteristics which allow the invention to be easily stored after using the invention and during any periods of non-use. In the stored state the securing mechanism 70 may be connected, by way of its hook-shaped second end 74, to the cap chain 35 by hooking the second end 74 through one of the cap chain links 41. Then, the present invention can be tucked, along with the cap chain, into the tank spout inlet 26. Finally, after the tank cap 30 is tightened over the tank spout 26, the present invention will remain stored within the confines of the tank spout 26.

At any subsequent fueling opportunity, the present invention can be easily used. Upon loosening and removing the tank cap 30, the present invention can be removed from storage inside of the tank spout 26 by pulling the tank cap 30 away from the spout opening. As the cap chain 35 is pulled out of the spout by pulling the cap 30 outward, the invention 50 will also be pulled out of the spout. After inserting the dispensing nozzle 10 and as the invention is exposed from its storage, the invention securing mechanism 70 can be removed from its attachment to the cap chain 35 by unhooking the securing mechanism's hook-shaped second end 74. Then, the dispensing nozzle 10 can be secured to the tank spout 25 by latching the hook-shaped second end 74 onto the dispensing nozzle 10.

As described above, a member 77 extends from the securing mechanism and provides a handle. The handle makes manipulating the invention easier considering the size of the hook and possibility that the user may be wearing gloves or working under other conditions that would render manipulation difficult.

The many features and advantages of the present invention will be apparent from the above description. Since numerous modifications and changes may be evident to and executed by those skilled in the art, the invention is not limited to the exact construction and operation illustrated and described herein. Accordingly, such modifications and changes are believed to be within the scope and sphere of the present invention.

What is claimed is:

1. A device for securing a dispensing nozzle to a fill tank possessing a tank cap and cap chain, the device comprising:

a hook connected to said cap chain, the hook being adapted for attachment to the dispensing nozzle, whereby such attachment prevents the nozzle from disengaging from the fill tank, wherein the hook includes a handle extending from a body of the hook, and wherein the handle provides a means to easily maneuver and operate the device.

2. The device of claim 1 further comprising a means for connecting the hook to the cap chain.

3. The device of claim 2 wherein the means for connecting is selected from a group consisting of ties, clasps, welds, clamps, latches, toggles, hooks, clips, pins, prongs, anchors, nut and bolt combinations, snaps, cable, rope, chains with at least one link, and a combination thereof.

4. The device of claim 2 wherein the means for connecting comprises:

a flexible member having a proximal end and distal end;

said proximal end for connection to the chap chain and said distal end for connection to the hook.

5. The device of claim 4 wherein the flexible member is selected from the group consisting of a chain with at least one link, cable, and rope.

6. The device of claim 4 wherein the flexible member is a chain with at least one link.

7. The device of claim 2, the hook comprising:

a first end having portions defining a void, wherein said means for connection can engage with the void, and a hook-shaped second end, said second end for attachment to the dispensing nozzle.

8. A device for securing a dispensing nozzle to a fill tank possessing a fill spout, the device comprising:

a fill-tank cap providing means for preventing contents of said fill tank from spilling out of the fill spout;

a cap chain having an end A and an end B, the cap chain connected at end A to said fill tank and connected at end B to said fill-tank cap; and a securing mechanism connected to said cap chain, the securing mechanism including a hook, wherein the hook includes a handle extending from a body of the hook, and wherein the handle provides a means to easily maneuver and operate the device.

9. The device of claim 8 further comprising a means for connecting the hook securing mechanism to the cap chain.

10. The device of claim 9 wherein the means for connecting is selected from a group consisting of ties, clasps, welds, clamps, latches, toggles, hooks, clips, pins, prongs, anchors, nut and bolt combinations, snaps, cable, rope, chains with at least one link, and a combination thereof.

11. The device of claim 9 wherein the means for connecting comprises:

a flexible member having a proximal end and distal end; and a means for connecting said proximal end to the cap chain, said distal end for connection to the hook.

12. The device of claim 11 wherein the flexible member is selected from the group consisting of a chain with at least one link, cable, and rope.

13. The device of claim 11 wherein the flexible member is a chain with at least one link.

14. The device of claim 9, the hook comprising:

a first end having portions defining a void, wherein the means for connection can engage with the void; and a hook-shaped second end, said second end for attachment to the dispensing nozzle.

15. A device for securing a dispensing nozzle to a fill tank possessing a tank cap and cap chain, the device comprising:

a means for connection that connects the device to the cap chain; and a securing mechanism adapted for attachment to the dispensing nozzle, whereby such attachment prevents the nozzle from disengaging from the fill tank, wherein the securing mechanism includes:

(a) a first end having portions defining a void, wherein the means for connecting engages with the void;

(b) a handle comprising a base and a projecting member, said base extending from the first end and said projecting member extending from said base and providing a means to maneuver and operate the device; and (c) a hook-shaped second end also extending from said base, said second end for attachment to the dispensing nozzle.

* * * * *